US006876832B2

(12) United States Patent
Pirwitz et al.

(10) Patent No.: US 6,876,832 B2
(45) Date of Patent: Apr. 5, 2005

(54) FUSER APPARATUS HAVING CLEANING WEB SPOOLING PREVENTION

(75) Inventors: Robert G. Pirwitz, Pittsford, NY (US); Robert S. Pawlik, Webster, NY (US); Robert R. Tuchrelo, Williamson, NY (US); Thomas C. Fowler, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 56 days.

(21) Appl. No.: 10/455,483

(22) Filed: Jun. 5, 2003

(65) Prior Publication Data

US 2004/0247351 A1 Dec. 9, 2004

(51) Int. Cl.[7] ..... G03G 15/20

(52) U.S. Cl. ..... 399/327; 399/329; 399/352; 399/325

(58) Field of Search ..... 399/327, 329, 399/352, 325; 242/538.1, 53; 15/256.51

(56) References Cited

U.S. PATENT DOCUMENTS 5,049,944 A 9/1991 DeBolt et al.
5,200,785 A 4/1993 Hoover et al.
5,749,038 A 5/1998 Fromm et al.
6,006,063 A * 12/1999 Shimizu et al. ..... 399/325
6,266,496 B1 * 7/2001 Rush et al. ..... 399/67
6,532,353 B1 3/2003 Orchard et al.

* cited by examiner

*Primary Examiner*—Arthur T. Grimley
*Assistant Examiner*—Peter Lee
(74) *Attorney, Agent, or Firm*—William Henry

(57) ABSTRACT

A fuser for an electrophotographic printer or copier has a fuser roll and pressure roll that form a nip through which a recording paper having a toner image is passed to fuse the toner image thereon. The fuser includes a cleaning web system to clean the fuser roll having a web supply roll, a tension roll to press the web against the fuser roll, and a web take up roll. To prevent spooling of the web from the supply roll during a paper jam clearance while the pressure roll is in contact with the fuser roll, a torsion spring is mounted on the tension roll shaft. The torsion spring provides enough torsional force on the tension roll to prevent rotation thereof during a jam clearance, thus preventing web spooling. During normal operation, the take up roll intermittently overcomes the torsion spring to step the web thereon.

9 Claims, 4 Drawing Sheets

FUSER APPARATUS HAVING CLEANING WEB SPOOLING PREVENTION

BACKGROUND OF THE INVENTION

The present invention relates to a fuser apparatus for an electrophotographic reproducing machine and, more particularly, to an improved fuser apparatus for such machine having a fuser roll and pressure roll that forms a nip through which a recording medium with a toner image is passed to fuse the image thereto, and a cleaning web system for cleaning the fuser roll with means for preventing inadvertent spooling of the web from the supply roll during a recording medium jam clearance.

One type of electrophotographic reproducing machine is a xerographic copier or printer. In a typical xerographic copier or printer, a photoreceptor surface is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as paper, and the surface of the photoreceptor is prepared to be used once again for the reproduction of a copy of an original. The paper with the powdered toner thereon in imagewise configuration is separated from the photoreceptor and moved through a fuser to permanently fix or fuse the toner image to the paper.

Typically, a fuser provides a combination of heat and pressure to form the permanent image on the paper. The basic architecture of a fuser is well known. Essentially, it comprises a pressure roll that rolls against a rotatable heated fuser roll to form a nip therebetween. A toner image-bearing sheet of paper is passed through the nip. The side of the paper having the toner image typically faces the fuser roll, which is often supplied with a heat source, such as a resistance heater, at the core thereof. The combination of heat from the fuser roll and pressure between the fuser roll and the pressure roll fuses the toner image to the paper, and once the fused toner cools, the image is permanently fixed to the paper.

In most fusing systems in use today, there is provided a system by which the fuser roll can be automatically cleaned and/or supplied with a lubricant or release agent. For high volume reproducing machines, the release agent is typically supplied from an open supply of liquid release agent that is ultimately applied to the fuser roll through one or more donor rollers. In contrast, for mid-volume to low volume reproducing machines, the cleaning and lubrication steps are provided to the surface of the fuser roll by means of a web. The web is urged against the surface of the fuser roll at a location generally away from the nip formed by the pressure and fuser rolls. The web provides a textured surface for removing particles of toner that remained on the fuser roll after the paper with the toner image has passed through the fuser. The web may also provide amounts of lubricant or release agent to the fuser roll. As is well known, the function of the release agent is to prevent sheets of paper that pass through the fuser nip from sticking to the surface of the fuser roll, thus causing a paper jam. In addition, the release agent minimizes the amount of toner that sticks to the fuser roll rather than remaining on the paper.

Generally, in most systems having a web for treating the fuser roll, the web is drawn from a replaceable supply roll and is moved at a reasonably slow rate relative to the movement of the fuser roll. Therefore, the motion of the fuser roll causes the surface of fuser roll to rub against a small area of the web. The relatively slow motion of the web provides friction to the fuser roll surface and provides a supply of clean web at a reasonable rate. A typical ratio of surface speeds, for example, in a 60 PPM printer, is approximately 300 mm per second for the outer surface of the fuser roll, while in contrast, the speed of the web is 2 to 3 mm per minute.

In most prior art designs of a web feeder for a fuser, the web is withdrawn from a supply roll and pulled by and wound on a take up roll. Typically, the take up roll is driven slowly and the supply roll idles passively. Many structures have been proposed for providing the necessary slow but continuous motion of the web. Some prior art techniques include supplying an external motor separate from the motor driving the fuser roll, or providing a solenoid or ratchet arrangement. It is also known to vary the speed of the take up roll as the circumference of the web on the take up roll increases. Otherwise, if the rotational speed of the take up roll remains constant, the increase in the web circumference will cause a significant increase in the web speed and exhaust the supply of web prematurely.

Paper jam clearance from fusers present serious problems to manufacturers of electrophotographic printers and copiers, especially when web cleaning systems are used. Usually, the cleaning web is undesirably pulled or spooled from the passively rotated supply roll when the jammed paper is removed while the pressure roll is still in pressure contact with the fuser roll. Inadvertent spooling of the cleaning web may require a skilled technician to rewind or replace the web. Many existing printers and copiers overcome this problem by providing complex and expensive devices which automatically separate the pressure roll from the fuser roll when a jam occurs. Though automatically separating the pressure roll from the fuser roll enables the jammed paper to be readily removed without causing inadvertent web spooling, this solution is too costly and better solutions are necessary to prevent web spooling.

U.S. Pat. No. 5,749,038 discloses a fuser subsystem for an electrophotographic printer or copier having a web which cleans the fuser roll. The web is driven by a mechanism that enables a constant velocity of the web relative to the fuser roll surface without the need of a separate motor or controller, as well as compensates for changes in frictional coefficient between the fuser roll and the web.

U.S. Pat. No. 5,049,944 discloses an apparatus in which a cleaning web is urged against a fuser roll, and a control system is used to vary the operation of the motor that moves the web, so that the web is driven at a relatively constant linear speed at the contact nip of the web with the fuser roll.

U.S. Pat. No. 5,200,785 discloses a fusing subsystem in a replaceable cartridge that includes a fuser roll, an oil applying structure, a heating lamp, temperature sensors, and an access opening. The cartridge electrical connector mates with a receiving electrical connector in reproducing machine.

U.S. Pat. No. 6,532,353 discloses a web cleaning mechanism for cleaning a fuser roll of a fuser assembly in a reproduction apparatus. The mechanism includes an elongated web of cleaning material supplied on a supply roll and a take up roll. A motor is coupled to the take up roll for selectively advancing the web against the fuser roll and onto the take up roll. An encoder associated with the motor produces a string of pulses while the motor is operative, and a logic and control unit activates the motor for a period of time in response to the number of pulses produced by the encoder.

SUMMARY OF THE INVENTION

It is an object of the present invention to provide a means to prevent the inadvertent spooling of fuser cleaning web from a supply roll during a jam clearance in the fuser while the pressure roll remains in contact with the fuser roll.

It is another object of the invention to provide an improved fuser apparatus having a fuser roll and pressure roll that forms a first nip through which a recording medium with a toner image thereon is passed to permanently fix the image thereto, and a cleaning web system for cleaning the fuser roll; the cleaning web system comprising a web provided on a supply roll having a shaft, a tension roll having a shaft, said tension roll forming a second nip with the fuser roll, the web passing through the second nip, and a take up roll having a shaft; and a torsion spring wrapped around at least one end of the tension roll shaft to function as a slip clutch and prevent rotation thereof during withdrawal of a recording medium from the first nip during a jam clearance in the fuser apparatus, thus preventing inadvertent spooling of web from the supply roll.

In one aspect of the invention, there is provided a fuser apparatus for use in an electrophotographic reproducing machine, comprising: a fuser roll mounted for rotation in a first direction; a pressure roll mounted for rotation and being parallel to the fuser roll, and said pressure roll being in contact with said fuser roll to form a first nip therebetween, so that passage of a recording medium having a toner image thereon through said first nip causes the toner image to be fused to said recording medium; a cleaning web supply roll with a supply roll shaft having a length of cleaning web stored thereon, the cleaning web having a free end, the supply roll being mounted for rotation about the supply roll shaft; a cleaning web take up roll having a take up roll shaft parallel to said supply roll shaft, the free end of the cleaning web being attached to said take up roll, the take up roll being mounted for rotation about the take up roll shaft; a cleaning web tension roll having a cylindrical outer surface and a tension roll shaft having opposing ends, the tension roll being mounted for rotation about the tension roll shaft, located parallel to said fuser roll, and disposed between the supply roll and the take up roll, the tension roll outer surface being spring biased toward the fuser roll outer surface to form a second nip at a location spaced from the first nip, said cleaning web being disposed in said second nip and in contact with the tension roll outer surface and the fuser roll outer surface; drive means for rotating the fuser roll and take up roll , so that the cleaning web disposed in said second nip moves in a direction opposite the first direction of the fuser roll; and a slip clutch comprising a torsion spring wrapped around at least one end of the tension roll shaft and having opposing ends, each end of the torsion spring having extensions extending tangentially from the tension roll shaft in a predetermined distance and direction, so that the torsion spring extensions are spaced apart and though lying in separate parallel planes appear to cross each other when viewed in a direction perpendicular to the tension roll shaft with one torsion spring extension contacting the supply roll shaft.

BRIEF DESCRIPTION OF THE DRAWINGS

The present invention will now be described, by way of example, with reference to the accompanying drawings, in which like reference numerals refer to like elements, and in which.

DESCRIPTION OF THE PREFERRED EMBODIMENT

Figure 1:
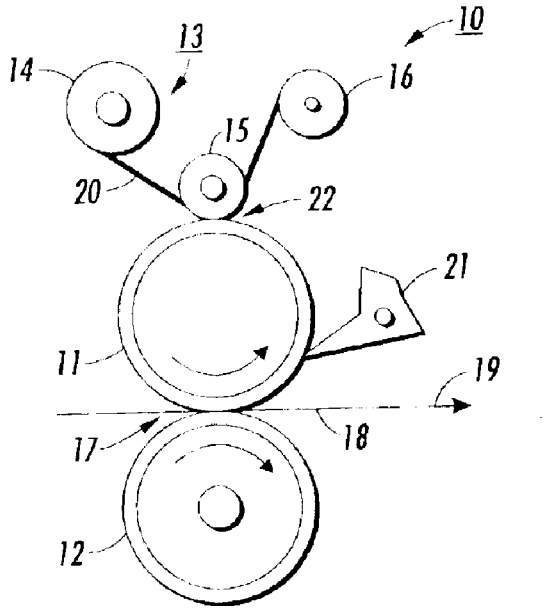
FIG. 1 PRIOR ART
FIGS. 1–3 illustrate a prior art replaceable fuser module having a web cleaning system that inadvertently spools web from a supply roll during a paper jam clearance from the fuser.
Figure 2:
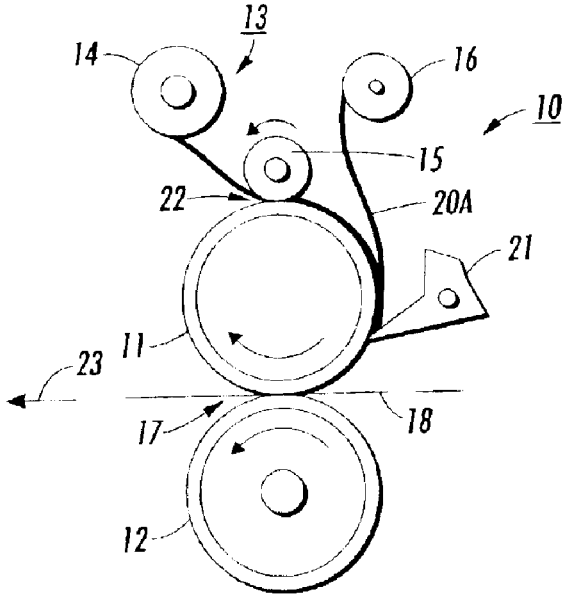
FIG. 2 PRIOR ART
Figure 3:
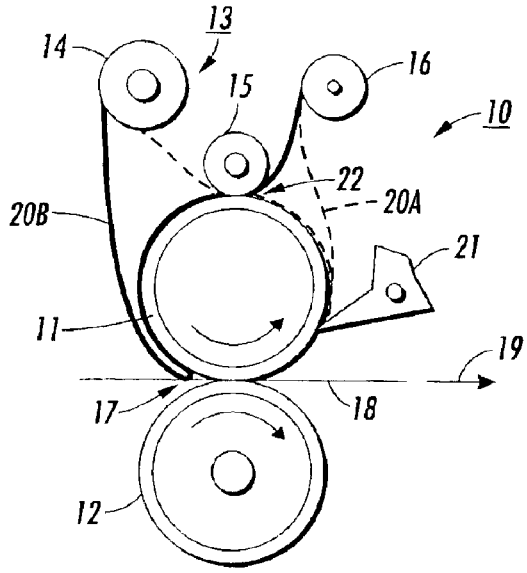
FIG. 3 PRIOR ART

FIGS. 1 through 3 schematically depict an end view of a typical fuser assembly or module 10 for a typical electrophotographic copier or printer (not shown). The fuser module generally consists of a fuser roll 11, pressure roll 12, and a web cleaning system 13. The fuser roll and pressure roll are rotatably mounted parallel to and in contact with each other to form a nip 17 through which a recording medium, such as paper 18, with a toner image thereon (not shown) is passed as indicated by arrow 19. A drive means (not shown) rotates the fuser and pressure rolls in the direction as shown in FIG. 1. As the paper with the toner image is passed through the nip 17, the toner image is permanently fused to the paper. Mechanical stripper fingers 21 assure that the paper with the permanent image is prevented from sticking to the fuser roll 11 and is transported through the nip 17. The web cleaning system includes a supply roll 14 having a length of web wrapped and stored thereon, a tension roll 15, and a take up roll 16, all of which are rotatably mounted parallel to each other and to the fuser and pressure rolls. The tension roll is urged into contact with the fuser roll 11 to form a nip 22 by means such as by one or more springs (not shown). The free end of the web is attached to the take up roll 16 and through nip 22, so that the tension roll presses the web against the fuser roll. As is well known, the supply roll and tension roll are generally not driven, with the take up roll driven at a speed much slower than the speed of the fuser roll and/or the pressure roll. Thus, the difference in speeds of the web to the surface of the fuser roll causes the required friction to enable the texture of the web to clean any toner or other debris from the fuser roll.

If a paper jam occurs in the fuser module 10, an operator of the copier or printer should mechanically separate the fuser roll from the pressure roll by, for example, a cam (not shown). Frequently, however, the operators simply pull the paper 18, from the nip 17, as shown in FIG. 2, in the direction of arrow 23. Removal of the jammed pa per 18 without separating the pressure roll from the fuser roll causes the fuser roll to rotate in a direction opposite to the normal operating direction shown in FIG. 1. This rotational direction of the fuser roll, in turn, causes a web portion 20A of the web to be pulled or spooled from the supply roll 14 and fed around the fuser roll 11 towards the stripper fingers 21. After jam clearance, the operation of the copier or printer is continued. As shown in FIG. 3, the removed web portion 20A (shown in dashed line) that has been inadvertently spooled from the supply roll travels around the fuser roll to a new location, shown as web portion 20B, and eventually the web portion enters the nip 17. Such an event produces a catastrophic failure of the web cleaning system, and when the fuser module contains the web cleaning system, replacement of the entire fuser module may be required. Such failures are extremely expensive, and must be avoided. The solution to this problem is solved by the invention described below in conjunction with FIGS. 4 through 7.

Figure 4:
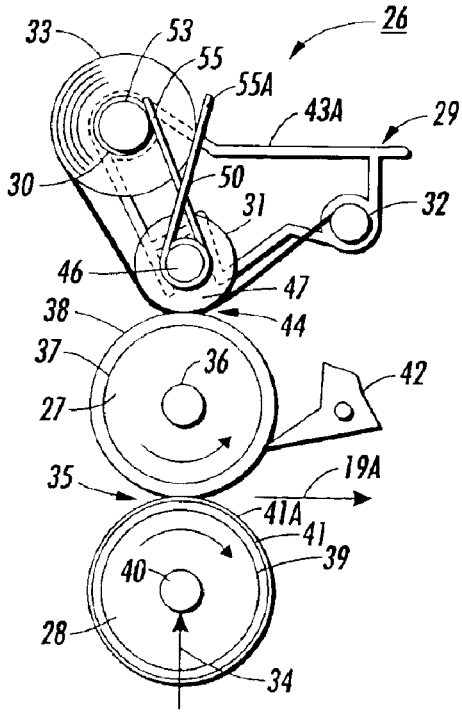
FIG. 4 is a schematic end view showing the essential portions of the fuser module of the present invention, including the fuser roll web cleaning system with a torsion spring slip clutch for web spooling prevention.

As is well known, a fuser assembly is a necessary part of an electrophotographic copier or printer. In FIG. 4, a schematic end view showing the essential portions of the fuser assembly or module 26 of the present invention is shown, including the fuser roll web cleaning system 29 with web spooling prevention. The fuser module 26 consists of a fuser roll 27 that is centrally heated, pressure roll 28, and a fuser roll web cleaning system 29. The fuser roll and pressure roll are parallel to each other and rotatably mounted in a fuser housing (not shown). The pressure roll is urged into contact with the fuser roll by a constant spring force, indicated by arrow 34, to form a nip 35 therebetween.

In one embodiment of the invention, the fuser roll 27 consists of an aluminum cylindrical sleeve 37 that is hollow and has an outer diameter of about 35 mm and a wall thickness about 5 mm thick. An end cap with a shaft extending therefrom (neither shown) is attached to each end of the sleeve. The cap shafts are coaxial with the axis of the sleeve and mounted on bearings (not shown) in the fuser housing. The outer surface of the sleeve has a Teflon® coating 38 containing silica carbide as an additive for anti-wear properties. Centrally located in the sleeve is a quartz halogen lamp 36 to internally heat the fuser roll. The pressure roll 28 is a cylindrical conformable roll and is constructed with a metal core 39, such as, for example, steel and has coaxially extending shafts 40 from each end mounted in the fuser housing on bearings (not shown). The metal core 39 has a layer of silicone rubber 41 on its outer surface that is covered by a conductive heat resistant material 41A, such as, Teflon®. A plurality of pivotal mechanical stripper fingers 42 are located against the fuser roll to aid in stripping the paper with fused toner images from the fuser roll and also act as a guide to exit the paper from the fuser nip 35. In accordance with well known procedure and thus not shown, the lamp 36 that heats the fuser is controlled by a contact thermistor in conjunction with the copier or printer controller. As is also known, a thermostat (not shown) is mounted internally of the fuser housing to control and prevent over heating of the fuser roll.

The conformable pressure roll 28 is urged against the fuser roll with enough force to generate the required nip width and pressure to support the fusing requirements of the copier or printer for the designed process speed. In the embodiment shown, the process speed is about 65 to 75 pages per minute (PPM). To accommodate the process speed of 65 to 75 PPM, the fuser roll surface speed is approximately 362 mm/sec. The conductive pressure roll 28 and the fuser web cleaning system 29 provides the required electrostatic discharge of both the fuser lo roll and the pressure roll surfaces to minimize image quality defects caused thereby.

Figure 5:
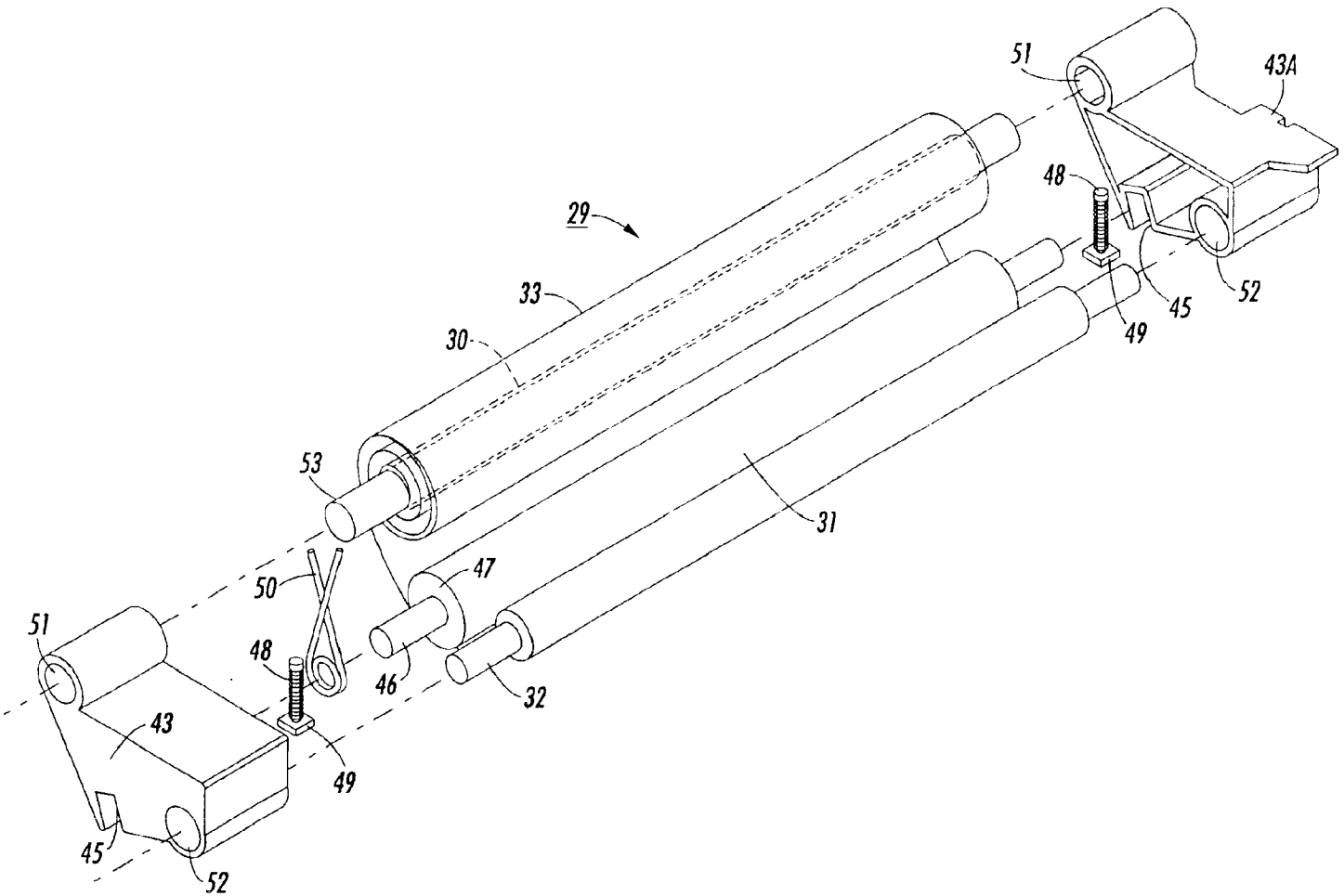
FIG. 5 is an exploded, isometric view of the web cleaning system shown in FIG. 4.

Referring to FIGS. 4 and 5, the web cleaning system 29 consists of a supply roll 30 having a shaft 53 therethrough, a tension roll 31 having a shaft 46 therethrough, and a take up roll 32, all of which are parallel to each other when they are rotatably mounted in the two support structures 43, 43A that are located at each end of the rolls. In FIG. 4, a schematic end view of the essential portions of the fuser module is shown, and in this view the front support structure 43 has been removed to show more clearly the torsion spring 50 that has been configured to function as a slip clutch, discussed later. FIG. 5 is an exploded, isometric view of the web cleaning system, and shows the support structures 43,43A holding the various rolls in the appropriate relationship with each other, with the tension roll located between the supply roll and the take up roll. The support structures also provide means for attaching the web cleaning system to the fuser housing, such as by locating features and screws or the like (none shown). The support structures each may typically be a one piece plastic molded member. Each support structure has respective holes 51,52 with bearing surfaces for the supply and take up rolls 30,32 and a slot 45 for the tension roll 31. Slots 45 accommodate both rotation of the tension roll and movement towards and away from the fuser roll 27.

When the web cleaning system 29 is installed in the fuser housing, the supply roll, tension roll, and take up roll are all parallel to the fuser roll with the tension roll in contact with the fuser roll to form nip 44. A length of web 33, having the appropriate texture and toner cleaning characteristics, is wrapped around and stored on the supply roll with a free end located around a portion of the tension roll and attached to the take up roll. The tension roll 31 consists of a cylindrically shaped, conformable, heat resistant material 47, such as a foam, formed on a steel shaft 46. After the various rolls are installed in the support structures 43,43A and the web cleaning system 29 is installed in the fuser housing, the tension roll presses the web against the fuser roll at nip 44. The essential components of the replaceable fuser module of the present invention comprise the fuser housing (not shown) with the web cleaning system 29, fuser roll 27, and pressure roll 28 installed therein.

The supply roll 30 with the web 33 and the tension roll 31 are not rotatably driven, though some slight drag is imposed on the rotatability of the supply roll, such as by a leaf spring (not shown), to prevent free wheeling and inadvertent unraveling of the web therefrom. The tension roll is rotatable in the slots 45 of the support structures 43,43A and two small coil springs 48 with shoes 49 are also located in the slots 45. Springs 48 apply a force on the shoes 49 that reside on opposing ends of the tension roll shaft 46, and thus urges the tension roll towards the fuser roll, thereby pressing the web against the fuser roll.

The take up roll is continually driven during copier or printer operation at about 2 to 3 mm per minute by a separate motor (not shown), while the fuser roll is driven at about 300 mm per second. This difference in relative lineal speed of the web and surface speed of the fuser roll provides the necessary friction to enable the web surface texture to clean off any toner left on the fuser roll.

Any suitable web material capable of withstanding fusing temperatures of the order of 225° C. may be employed. The web material may be woven or non-woven, so long as it has a surface texture suitable to collect toner from the fuser roll and has a sufficient thickness and strength to prevent the web from being torn when the web is pulled through the nip 44 by the take up roll.

Figure 6:
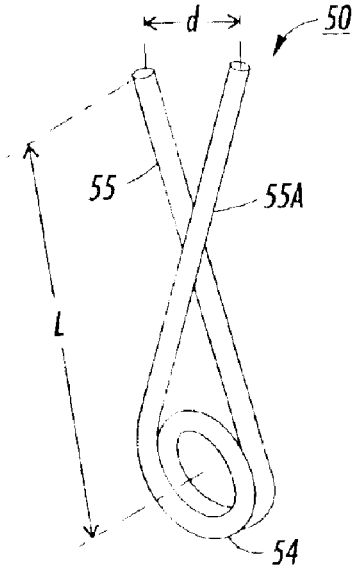
FIG. 6 is an isometric view of the torsion spring slip clutch.
Figure 7:
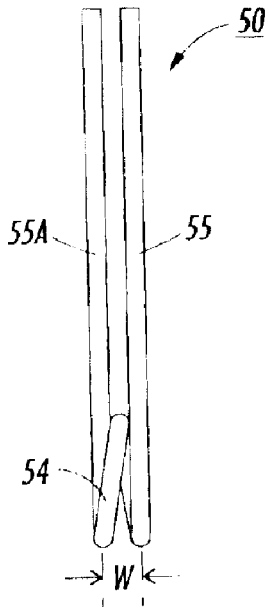
FIG. 7 is a side view of the torsion spring slip clutch shown in FIG. 6.

To prevent the web spooling problem discussed with reference to FIGS. 1 to 3, a torsion spring 50 is formed as shown in FIGS. 6 and 7 and mounted on one end of the shaft 46 of the tension roll 31. Optionally, a torsion spring 50 could be mounted on both ends of tension roll shaft 46. The torsion spring 50 comprises a length of music wire having opposing ends 55,55A. The torsion spring is formed to surround the tension roll shaft with a coil 54 having at least two wraps around the tension roll shaft 46 with the opposing ends 55,55A having straight extensions extending tangentially from the tension roll shaft in predetermined directions. The torsion spring extensions are substantially equal in length and have a length sufficiently long to enable one of the torsion spring extensions to contact the supply roll shaft 53. The extensions lie in separate parallel planes, but when viewed from the side as shown in FIG. 4, the extensions appear to cross each other.

The internal diameter of the torsion spring coil 54 is sized to fit tightly around the tension roll shaft 46 and grips the tension roll shaft 46 with sufficient force to prevent the tension roll shaft from rotating when the take up roll 32 is not being driven. Thus, when a jam occurs in the fuser module, operation of the fuser module is stopped and the drive (not shown) to the fuser roll and take up roll is inactivated. Any paper left in the nip 35 when the jam occurs must be removed before operation of the fuser can be started again. The normal procedure is to separate the pressure roll 28 from the fuser roll 27 by means of a manually operated lever and cam arrangement (not shown). However, as discussed before, an operator many times does not obey instructions and merely withdraws the paper from the nip 35 in a direction opposite to the process direction indicated by arrow 19A (FIG. 4). In this event, the torsion spring coil 54 provides enough frictional grip to prevent relative rotation between the torsion spring 50 and the tension roll shaft 46. Since one end extension 55 of the torsion spring resides against the supply roll shaft 53, the attempted counterclockwise rotation of the free wheeling tension roll caused by withdrawal of a jammed sheet of paper in a direction opposite to arrow 19A is prevented. This is because the frictional grip of the torsion spring on the tension roll shaft is greater than the friction generated between the web and the surface of the fuser roll. Therefore, when an operator pulls a jammed sheet of paper from the fuser nip 35 in a direction opposite to arrow 19A, the fuser roll is moved in the clockwise direction (as viewed in FIG. 4) against the web that is held stationary by the torsion spring.

During normal operation, the take up roll slowly pulls the web through the cleaning web nip 44 while the coiled springs 48 keep the tension roll urged towards the fuser roll and squeezing the web in the nip 44 against the fuser roll. When the web 33 is pulled by the take up roll 32, a torsional force is generated on the tension roll shaft in the counterclockwise direction (as viewed in FIG. 4). When this occurs, the grip of the torsion spring coil 54 causes the force to be applied against the supply roll shaft 53 by the torsion spring extension 55. This force is sufficient on the torsion spring end extension 55 to cause the extension 55 to be rotated slightly in the clockwise direction, thus unwrapping a small portion of the coil 54 from the tension roll shaft and momentarily reducing the frictional gripping force of the torsion spring coil on the tension roll shaft. Once the gripping force of the torsion spring on the tension roll shaft has been momentarily reduced, a portion of the web is pulled through the nip 44 by the slight rotation of the tension roll and onto the take up roll. As soon as the tension roll is permitted a slight rotation, the force on the torsion spring extension 55 is substantially reduced and the coil 54 of the torsion spring 50 re-grips the tension roll shaft 46 and stops further rotation thereof. The frictional grip of the torsion spring coil 54 again causes the force applied by torsion spring extension 55 against the supply roll shaft 53 to be sufficient to momentarily unwrap a small portion of the coil 54 and temporarily reduce the coil's frictional grip. This process is repeated as long as the take up roll is withdrawing web 33 from supply roll 30 and through nip 44. Thus, the web is stepped one small portion at a time from the supply roll 30 even though the take up roll 32 is continually driven.

In this manner of operation by the torsion spring 50, it functions as a slip clutch. The torsion spring is designed to provide the minimum frictional force required to prevent spooling of the web 33 during a jam clearance with the pressure roll 28 contacting the fuser roll 27 and a maximum frictional force that is to be overcome by the driven take up roll 32.

One additional benefit of the torsion spring 50 is that an extra force is applied against web in a direction opposite to the direction of web produced by the take up roll, so that the used web is wound tighter on the take up roll. The torsion spring in this slip clutch configuration has been found to increase the amount of used web wrapped on the take up roll by about 30%. The available space for the used web on the take up roll determines the amount of web to be provided on the supply roll. Since the torsion spring slip clutch enables about 30% more used web on the take up roll, an equal amount of more cleaning web can be provided on the supply roll. This means an increase in the number of sheets of paper with toner images that can be fused before the fuser module must be replaced or web cleaning system must be replenished.

FIGS. 6 and 7 show an isometric view and a front elevation view respectively of the torsion spring 50 in the configuration of a slip clutch. For the preferred embodiment, the minimum torsional or rotational resistance for a tension roll shaft 53 having a radius of 4 mm and requiring a force of about 10 newtons (N) to rotate is about 10 Ncm, while the upper torsional resistance is limited to about 17 Ncm. The music wire, from which the torsion spring 50 in the configuration of a slip clutch is formed, has a diameter of about 1.1 mm and the coil 54 has an internal diameter of about 8 mm. The length (L) of each end extension 55,55A from the center of the coil 54 is about 30 mm, while the distance (d) between the distal ends of the crossed extensions is about 13.7 mm. The total width (W) of the torsion spring as viewed in FIG. 7 is about 3.5 mm. The torsion spring 50 is symmetrical, so that it may be mounted on either end of the tension roll shaft 46, and either end extension 55 or 55A may be placed into contact with the supply roll shaft 53.

The location of the torsion spring 50, formed as shown in FIGS. 6 and 7, and mounted on the tension roll shaft 46 permits the tension roll 31 to be incrementally rotated by the take up roll 32 during normal operation. The torsion spring does not impede the normal force of the web 33 on the fuser roll 27 as the web passes through the nip 44 formed by the tension roll 31 and fuser roll 27. When a jam occurs in the fuser module, the drive to the fuser roll and take up roll is inactivated. If the jammed paper in the nip 35 formed by the fuser roll 27 and pressure roll 28 is withdrawn while the pressure roll is still in contact with the fuser roll, the torsion spring 50 prevents the spooling of web 33 from supply roll 30 by preventing the rotation of the tension roll 31. The above results are enabled by the torsion spring 50 being located on at least one end of the tension roll shaft 46 of the cleaning web system 29. The torsion spring is designed to provide enough torsional drag to prevent the tension roll 31 from being rotated by the rotation of the fuser roll 27 during a paper jam clearance while the pressure roll 28 is still in contact with the fuser roll. Concurrently, the upper limit on the torsional drag or frictional grip of the torsion spring coil 54 allows the tension roll 31 to rotate incrementally during normal operation of the take up roll to take up the used web.

Although the foregoing description illustrates the preferred embodiment, other variations are possible and all such variations as will be apparent to those skilled in the art are intended to be included within the scope of this invention as defined by the following claims.

What is claimed is:

1. An improved fuser apparatus, comprising:

a fuser roll and a pressure roll being rotatably mounted parallel to and in contact with each other to form a first nip through which a recording medium with a toner image thereon is passed to permanently fix the image thereto;

a cleaning web system for cleaning the fuser roll, the cleaning web system including a web provided on a supply roll, a tension roll having a shaft with opposing ends, and a take up roll, the supply roll, tension roll, and take up roll all being mounted for rotation, said tension roll forming a second nip with the fuser roll, the web passing through the second nip to clean the fuser roll and the web portion used to clean the fuser roll being stored on the take up roll;

a torsion spring mounted on at least one end of the tension roll shaft, the torsion spring gripping the tension roll shaft with sufficient frictional force to provide a range of torsional drag forces on the tension roll shaft to prevent rotation thereof during withdrawal of a recording medium from the first nip during a jam clearance in the fuser apparatus, thus preventing inadvertent spooling of web from the supply roll; and wherein the range of torsional drag forces by the torsion spring has a minimum drag force to prevent rotation of the tension roll during a jam clearance and a maximum drag force that is periodically overcome by the rotational force of the take up roll during normal operation of the fuser, so that the cleaning web is stepped from the supply roll onto the take up roll.

2. The fuser apparatus as claimed in claim 1, wherein the at least one torsion spring has a portion in a coil wrapped around said at least one end of the tension roll shaft with opposing ends of the torsion spring extending tangentially from the tension roll shaft for equal distances and in predetermined directions, the coil portion of the torsion spring gripping the tension roll shaft and providing a frictional grip that produces said torsional drag forces thereon, the torsion spring ends lying in separate parallel planes and being sufficiently long so that one torsion spring end contacts the supply roll and prevents rotation of the tension roll.

3. The fuser apparatus as claimed in claim 2, wherein rotation of said take up roll to withdraw web from said supply roll and pull the web through the second nip produces a torsional force on the tension roll shaft sufficient to cause said end of the torsion spring contacting the supply roll to unwrap a relatively small portion of said coil and thereby to lessen the frictional grip of said coil on the tension roll shaft, so that the tension roll overcomes the maximum drag force of said coil and rotates a relatively short distance; and wherein said rotation of the tension roll reduces the torsional force produced by the take up roll on the end of the torsion spring that contacts the supply roll, so that the coil of the torsion spring again provides a sufficient frictional grip on the tension roll shaft to stop rotation thereof momentarily, thus the tension roll is periodically rotated a short distance and then periodically stopped, so that the web stored on the take up roll is stepped thereon.

4. The fuser apparatus as claimed in claim 3, wherein the stepping of the web onto the take up roll enables the web to be more tightly wound thereon, resulting in about 30% more web being stored on the take up roll.

5. The fuser apparatus as claimed in claim 3, wherein the torsion spring is formed from music wire having a diameter of about 1.1 mm.

6. The fuser apparatus as claimed in claim 5, wherein the tension roll shaft has a diameter of about 4 mm; and wherein the minimum torsional drag force is about 10 Ncm and the maximum torsional drag force is about 17 Ncm.

7. A fuser apparatus for use in an electrophotographic reproducing machine, comprising:

a fuser roll mounted for rotation in a first direction;

a pressure roll mounted for rotation and being parallel to the fuser roll, and said pressure roll being in contact with said fuser roll to form a first nip therebetween, so that passage of a recording medium having a toner image thereon through said first nip causes the toner image to be fused to said recording medium;

a cleaning web supply roll with a supply roll shaft, the supply roll having a length of cleaning web stored thereon, the cleaning web having a free end, the supply roll being mounted for rotation about the supply roll shaft;

a cleaning web take up roll having a take up roll shaft parallel to said supply roll shaft, the free end of the cleaning web being attached to said take up roll, the take up roll being mounted for rotation about the take up roll shaft;

a cleaning web tension roll having a cylindrical outer surface and a tension roll shaft having opposing ends, the tension roll being mounted for rotation about the tension roll shaft, located parallel to said fuser roll, and disposed between the supply roll and the take up roll, the tension roll outer surface being spring biased toward the fuser roll outer surface to form a second nip at a location spaced from the first nip, said cleaning web being disposed in said second nip and in contact with the tension roll outer surface and the fuser roll outer surface; and a torsion spring wrapped around at least one end of the tension roll shaft to form a coil therearound, the torsion spring coil frictionally gripping the tension roll shaft to provide a range of torsional drag forces, the torsion spring having opposing ends, each end of the torsion spring having parallel extensions extending tangentially from the tension roll shaft for a predetermined distance and direction, so that the torsion spring extensions are spaced apart and, though lying in separate parallel planes, appear to cross each other when viewed in a direction perpendicular to the tension roll shaft with one torsion spring extension contacting the supply roll shaft.

8. The fuser apparatus as claimed in claim 7, wherein a recording medium jam occurring in said first nip causes the drive means to stop rotating said fuser roll and said take up roll; and wherein the torsional drag force produced on the tension roll shaft by the torsion spring coil and by the torsion spring extension being in contact with the supply roll prevents rotation of the tension roll and currently prevents spooling of the web, when a recording medium is withdrawn from said first nip to clear a jam while the pressure roll contacts the fuser roll.

9. The fuser apparatus as claimed in claim 7, wherein during normal operation of the reproducing machine, rotation of said take up roll by the drive means to withdraw web from said supply roll and pull the web through the second nip produces a torsional force on the tension roll shaft sufficient to cause said torsion spring extension contacting the supply roll to unwrap a relatively small portion of the coil and thereby lessen the frictional grip of said coil on the tension roll shaft, so that the tension roll overcomes the torsional drag force of the coil and rotates a relatively short distance; and wherein said rotation of the tension roll reduces the torsional force produced by the driven take up roll, so that the torsion spring coil again provides sufficient frictional grip on the tension roll to stop rotation thereof momentarily, resulting in the tension roll being intermittently rotated, so that the web is stepped onto the take up roll.

* * * * *